US007681258B2

(12) United States Patent
Ciechanowski et al.

(10) Patent No.: US 7,681,258 B2
(45) Date of Patent: Mar. 23, 2010

(54) ACCESSORY ANCHORING DEVICE FOR WASHING/BATHING TUB

(75) Inventors: Dominique Ciechanowski, Sainte-Marguerite-de-Dorchester (CA); Miguel Castellote, Sainte-Marguerite-de-Dorchester (CA)

(73) Assignee: C.G. Air Systèmes Inc., Sainte-Marguerite-De-Dorchester, Québec (CA)

( * ) Notice: Subject to any disclaimer, the term of this patent is extended or adjusted under 35 U.S.C. 154(b) by 851 days.

(21) Appl. No.: 11/069,559

(22) Filed: Mar. 2, 2005

(65) Prior Publication Data

US 2005/0193486 A1 Sep. 8, 2005

Related U.S. Application Data

(60) Provisional application No. 60/548,883, filed on Mar. 2, 2004.

(51) Int. Cl.
*A47K 3/00* (2006.01)

(52) U.S. Cl. ..... 4/559; 4/541.6

(58) Field of Classification Search ..... 4/541.6, 4/559, 661

See application file for complete search history.

(56) References Cited

U.S. PATENT DOCUMENTS

| | | | | |
|---|---|---|---|---|
| 4,337,540 | A | 7/1982 | Lindeman | |
| 4,541,131 | A | 9/1985 | Sussman | |
| 4,566,662 | A | 1/1986 | Toshihlge | |
| 5,181,621 | A | 1/1993 | Plaehn | |
| 5,381,563 | A * | 1/1995 | Isabelle et al. | 4/541.6 |
| 5,499,725 | A | 3/1996 | Palumbo | |
| 5,743,570 | A | 4/1998 | Garland | |
| 5,829,069 | A | 11/1998 | Morgan et al. | |
| 5,940,903 | A | 8/1999 | Yeminl | |
| 6,092,772 | A | 7/2000 | Garcia et al. | |
| 6,263,522 | B1 * | 7/2001 | Dongo et al. | 4/541.6 |
| 6,453,484 | B1 * | 9/2002 | Pinciaro | 4/541.6 |
| 6,745,413 | B2 * | 6/2004 | Pinciaro | 4/541.6 |

* cited by examiner

*Primary Examiner*—Tuan N Nguyen
(74) *Attorney, Agent, or Firm*—Ogilvy Renault

(57) ABSTRACT

A device for anchoring accessories to a surface of a tub has a fluid injection jet. The device comprises a connector adapted to be connected to an accessory. An anchor is interconnected to the connector, and is adapted to be connected to the fluid injection jet. A fluid passage is formed in the device so as to enable fluid to be injected therethrough and into the tub when the anchor is connected to the fluid injection jet. A method of anchoring accessories is also provided.

7 Claims, 5 Drawing Sheets

ACCESSORY ANCHORING DEVICE FOR WASHING/BATHING TUB

CROSS-REFERENCE TO RELATED APPLICATION

This patent application claims priority on U.S. Provisional Patent Application No. 60/548,883, filed on Mar. 2, 2004, by the present applicants.

BACKGROUND OF THE INVENTION

1. Field of the Invention

The present invention generally relates to washing/bathing tub accessories and, more particularly, to an accessory anchoring device for anchoring accessories to a surface of a washing/bathing tub.

2. Background Art

Tubs are well known for their primary use, namely a washroom installation in which a user person washes, bathes. Tubs have however evolved to add pleasure and comfort to practicality, and are found in many forms, such as bathtubs, spas, whirlpools. For instance, tubs are now provided with air jet systems, whirlpool systems.

Accessories, such as cushions, arm and leg rests, foot massage systems, have been developed to accommodate the bather. Various types of anchoring devices have been developed to anchor such accessories to tub walls, such that the accessories will remain in position against the tub walls, notwithstanding the buoyant forces.

For instance, suction cups have been used to secure some accessories, such as cushions, to the tub. The efficiency of suction cups to anchor accessories is questionable. The effect of the buoyant forces on the accessory may be sufficient to dislodge the suction cups.

Other types of anchoring devices include hooks, clips or the like, for instance received in receptacles anchored to a surface of the tub. The receptacles are in some cases glued to the surface of the tub, in which case they make up a relatively weak bond, as water may infiltrate and affect the effectiveness of the bonding agent.

Alternatively, some anchoring devices are secured directly through the surface of the tub. This results in the presence of anchoring holes/perforations in the surface of the tub. Perforations in tub walls for anchoring devices must be suitably sealed to prevent leaks through these perforations. Accordingly, anchoring devices for such perforations must include sealing devices and/or sealing configurations. If the anchoring devices are removed, they leave a mark in the surface of the tub.

SUMMARY OF INVENTION

It is an aim of the present invention to provide a novel anchoring device for securing accessories to washing/bathing tub walls.

It is a further aim of the present invention to provide an anchoring device that addresses the issues pertaining to the prior art;

It is a still further aim of the present invention to provide an anchoring device that does not require additional holes to be defined in a wall of the washing/bathing tub to be used.

It is a still further aim of the present invention to provide a novel method for anchoring an accessory to a wall of a washing/bathing tub.

Therefore, in accordance with the present invention, there is provided a device for anchoring accessories to a surface of a tub having a fluid injection jet, comprising a connector adapted to be connected to an accessory, an anchor interconnected to the connector, and adapted to be connected to the fluid injection jet, and a fluid passage formed in the device so as to enable fluid to be injected therethrough and into the tub when the anchor is connected to the fluid injection jet.

Further in accordance with the present invention, there is provided a method for anchoring accessories to a surface of a tub having a fluid injection jet, comprising the steps of providing a device having a connector, an anchor, and a fluid passage in the device, connecting an accessory to the connector, and connecting the anchor to the fluid injection jet, such that the fluid passage of the device is in fluid communication with an outlet of the fluid injection jet, whereby the accessory is secured to the surface of the tub and fluid exits the fluid injection jet and passes through the fluid passage of the device.

BRIEF DESCRIPTION OF THE DRAWINGS

Reference will now be made to the accompanying drawings, showing by way of illustration embodiments of the invention and in which.

DESCRIPTION OF THE PREFERRED EMBODIMENTS

Figure 1:
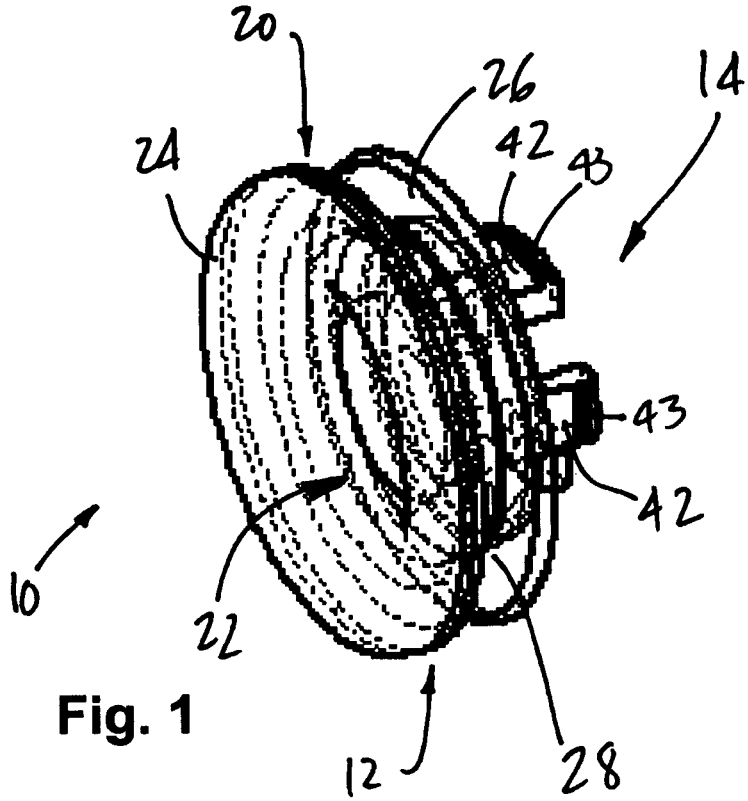
FIG. 1 is a front perspective view of an anchoring device constructed in accordance with a first embodiment of the present invention.
Figure 2:
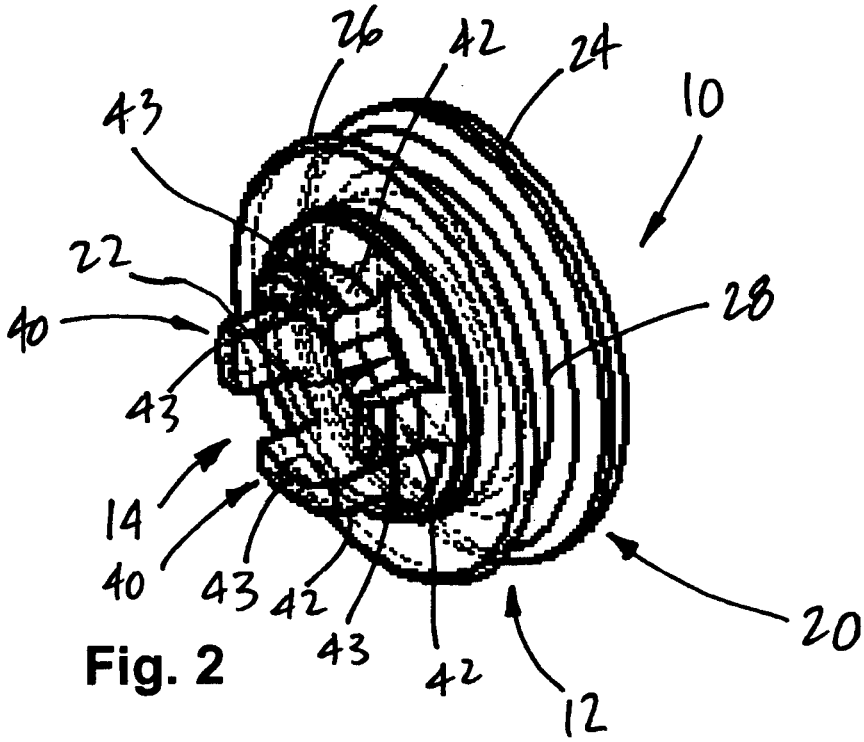
FIG. 2 is a rear perspective view of the anchoring device of FIG. 1.
Figure 3:
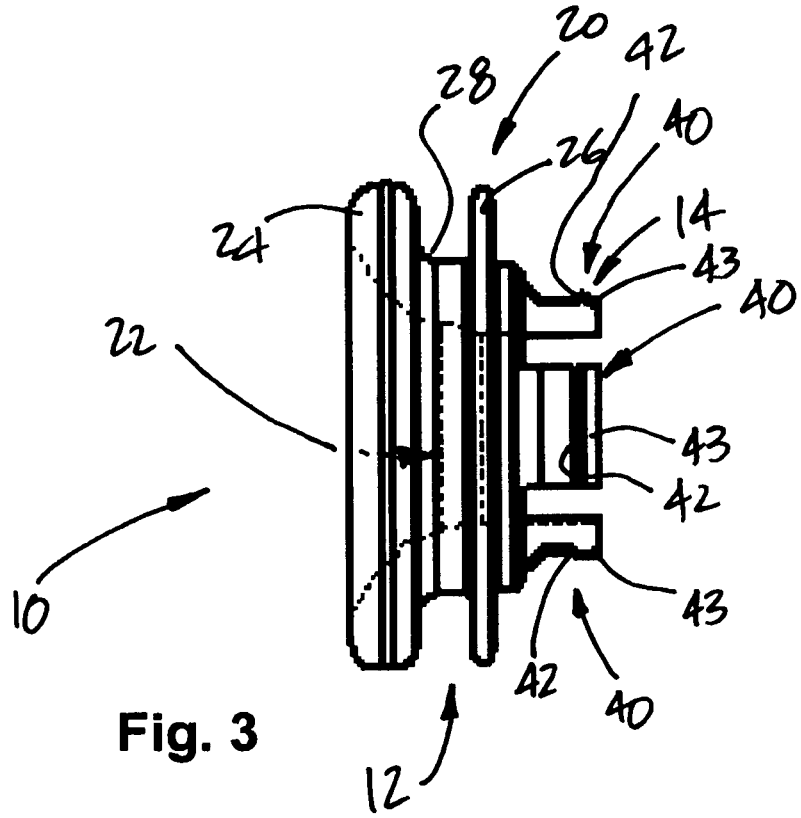
FIG. 3 is an elevation view of the anchoring device of FIG. 1.
Figure 4:
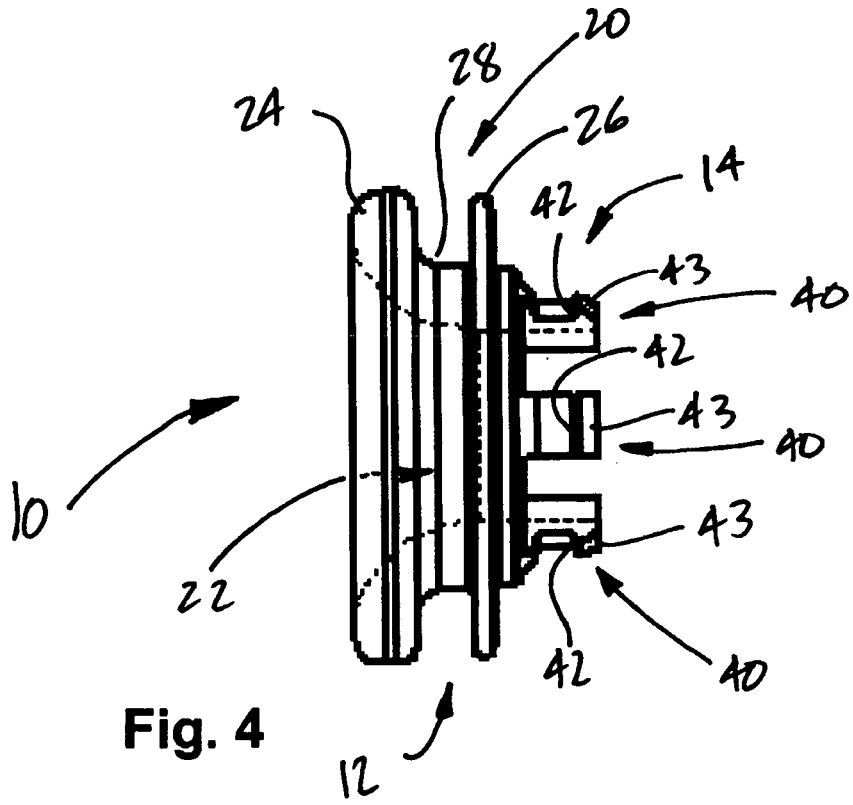
FIG. 4 is a plan view of the anchoring device of FIG. 1.

Referring to the drawings and, more particularly, to FIGS. 1 to 4, an anchoring device is generally shown at 10. The anchoring device 10 has an accessory connector 12 and a tub anchor 14.

Accessories are mounted to the accessory connector 12. The tub anchor 14 is used to anchor the anchoring device 10 to a wall of the washing/bathing tub (hereinafter, the tub).

The Accessory Connector 12

Referring concurrently to FIGS. 1 to 4, the accessory connector 12 has an annular body 20. The annular body 20 defines a passage 22. The annular body 20 has a pair of flanges, namely a downstream flange 24 and an upstream flange 26, with respect to a direction of fluid passing through the passage 22, as will be described hereinafter. A peripheral groove 28 separates the downstream flange 24 from the upstream flange 26.

Figure 5:
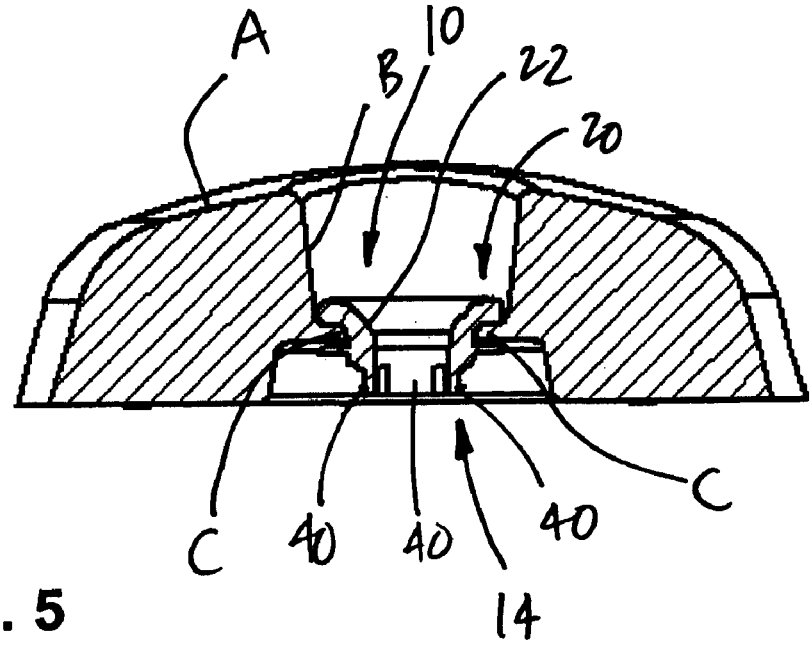
FIG. 5 is a cross-section view of the anchoring device of FIG. 1, with an accessory mounted thereto.

Referring to FIG. 5, the anchoring device 10 is shown having an accessory A connected to the accessory connector 12. The accessory A defines an opening B having a throat C.

The throat C is received within the annular groove 28 of the accessory connector 12. Accordingly, the accessory A is retained to the anchoring device 10, by its throat C held captive between the downstream flange 24 and the upstream flange 26.

Connection of an Accessory to the Device 10

In order to engage the accessory to the anchoring device 10, a portion of the throat C of the accessory A is positioned into a portion of the annular groove 28. Thereafter, the anchoring device 10 is pivotally snap-fitted to the accessory A, whereby the throat C is fully received in the annular groove 28. Either one of the throat C and the upstream flange 26 bends or deforms to enable the engagement between the accessory A and the anchoring device 10.

Typically, the anchoring device 10 is formed of a plastic, a metal or other material of suitable density so as to have some resilience. Also, depending on the type of accessory A, it is possible that the throat C deforms or bend rather than the upstream flange 26.

The Tub Anchor 14

Referring concurrently to FIGS. 1 to 4, the tub anchor 14 has pairs of diametrically opposed fingers 40. Preferably, the fingers 40 each have a wedge 42. Slanted surfaces 43 are provided adjacent to the wedges 42, at a tip of the fingers 40.

The fingers 40 each have a free end, at which the respective wedges 42 are positioned, and thus have some level of resilience. As mentioned previously, the anchoring device 10 is made of a plastic, a metal or other flexible material. Therefore, the fingers 40 can bend toward one another, while being biased toward their initial position illustrated in FIG. 5, in which the fingers 40 are substantially parallel to one another.

Connection of the Device 10 to a Tub Wall

Figure 6:
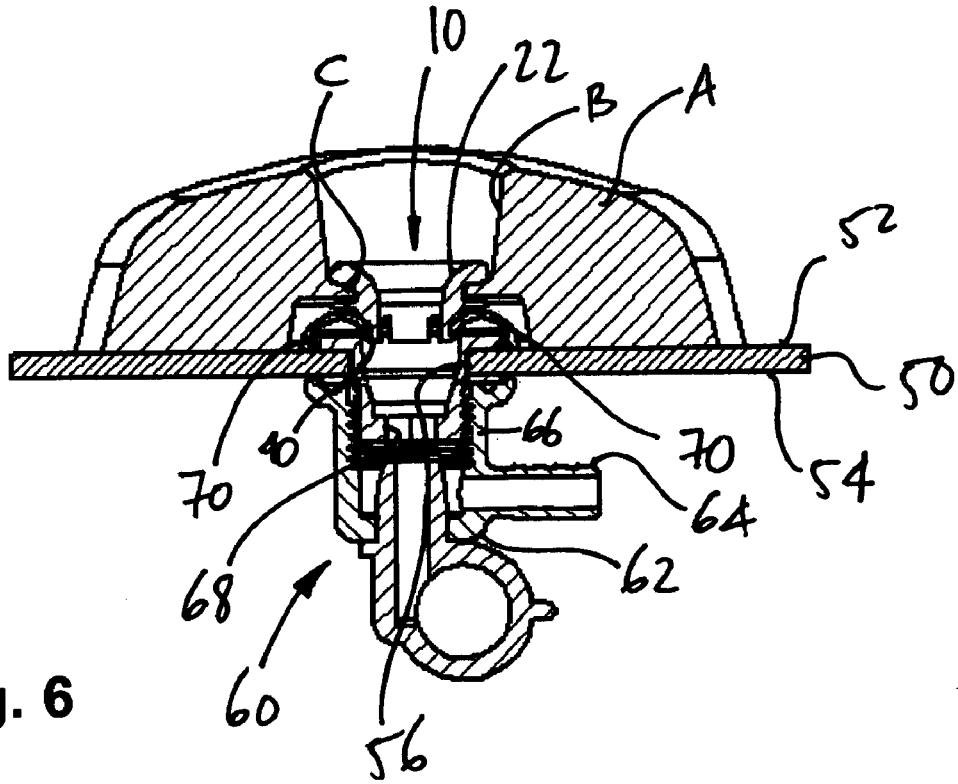
FIG. 6 is a cross-section view of the anchoring device of FIG. 1, as secured to a jet of a massage system and with an accessory mounted thereto.

Referring to FIG. 6, a tub wall is generally shown at 50. The tub wall 50 has a visible surface 52, that defines the water-receiving cavity of the tub, and a hidden surface 54. The tub wall 50 has a plurality of perforations therein, one of which is shown at 56 in FIG. 6, for the installation of a massage system to the tub. The massage system (i.e., air massage system, whirlpool system) has jets (or nozzles, outlets, etc.) by which fluid is injected into the water-receiving cavity of the tub, to procure a massage sensation for the bather.

A jet 60 of a massage system is installed in the perforation 56 in the tub wall 50. As mentioned previously, the jet 60 is used to inject a fluid (e.g., air, water or the like), through the perforation 56 and into the water receiving cavity of the tub.

The jet 60 has inlet connectors 62 and 64, and a body 66 by which the jet 60 is secured to the tub wall 50. The jet 60 defines a passage 68 in fluid communication with the inlet connectors 62 and 64, such that a fluid received by the inlet connectors 62 and/or 64 reaches the water-receiving cavity of the tub by passing through the passage 68. The jet 60 has a decorative cap 70.

The anchoring device 10 of the present invention uses jets/nozzles of massage systems as support to stay positioned within the tubs. For example, the anchoring device 10 is connected to the jet 60 by way of the fingers 40 of the tub anchor 14 engaging to the decorative cap 70. More specifically, in the embodiment illustrated in FIG. 6, the wedges 42 cooperate with an upstream edge 72 of the decorative cap 70 to retain the anchoring device 10, and the accessory A, in position with respect to the tub wall 50. Alternatively, the wedges 42 could engage with any other edge suitably oriented in the jet 60.

In order to secure the anchoring device 10/accessory A combination to the jet 60, the anchoring device 10 is positioned opposite the jet 60, and pushed thereagainst. The slanted surfaces 43 will guide the fingers 40 into deflecting toward one another. More specifically, the slanted surfaces of the wedges 42 will slide against the surface of the decorative cap 70, whereby the fingers 40 will bend toward one another. Past the upstream edge 72 of the decorative cap 70 and farther into the jet 60, the fingers 40 bias back to their initial position, thereby causing a snap-fit effect when securing the anchoring device 10 to the accessory A. The anchoring device 10/accessory A combination, illustrated in FIG. 6, is secured to the jet 60, following the above described method.

In order to remove the anchoring device 10/accessory A combination from the jet 60, a slight tilt of the anchoring device 10/accessory A combination will dislodge the wedge members 42 from engagement with the upstream edge 72 of the decorative cap 70. The anchoring device 10 is then pulled out of the jet 60.

As will be described hereinafter, the anchoring device 10 of the present invention will be embodied in various configurations to cooperate with available edges of the jets of massage systems.

Injection of Fluid with the Jet 60

Referring to FIG. 6, once the anchoring device 10/accessory A combination is connected to the jet 60, the passage 68 of the jet 60 and the passage 22 of the anchoring device 10 are aligned, whereby fluid can freely be injected into the tub by the jet 60.

As seen in the embodiment of FIGS. 1 to 6, the passage 22 of the anchoring device 10 is flared in a downstream direction (with respect to an injection of fluid with the jet 60). It is contemplated to provide other geometries to the passage 22 to create different effects with the injected fluid. For instance, the passage 22 could be used to deflect a direction of the fluid exiting from the passage 68.

If the accessory A is a cushion, a limb rest or a foot support of a foot massage system, the bather abutting against the accessory will feel the effect of the massage system, because of the configuration of the anchoring device 10 of the present invention.

ALTERNATIVE EMBODIMENTS

Figure 7:
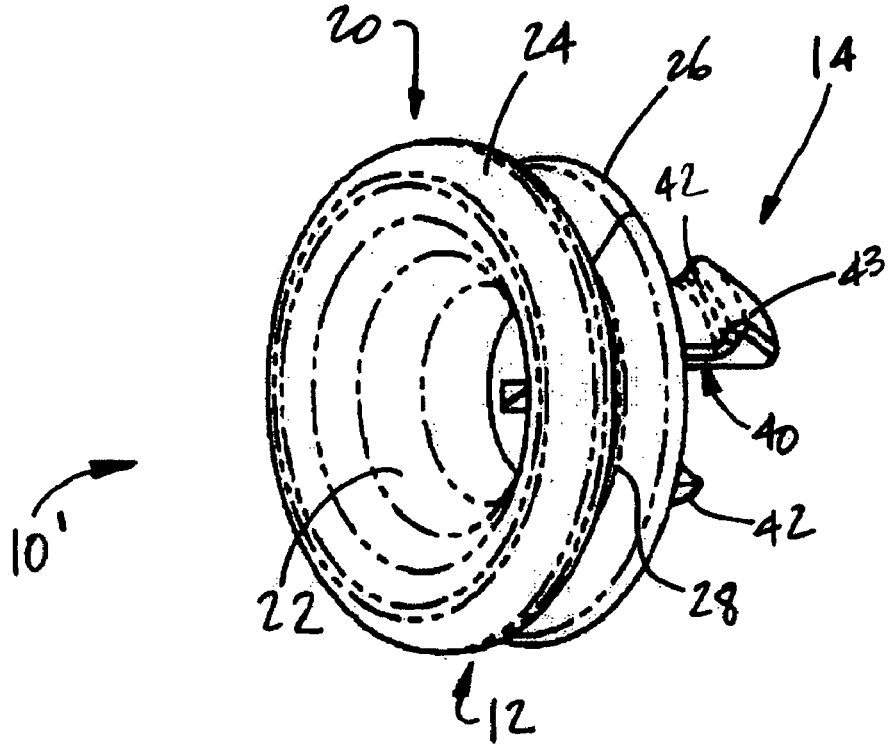
FIG. 7 is a front perspective view of an anchoring device constructed in accordance with a second embodiment of the present invention.
Figure 8:
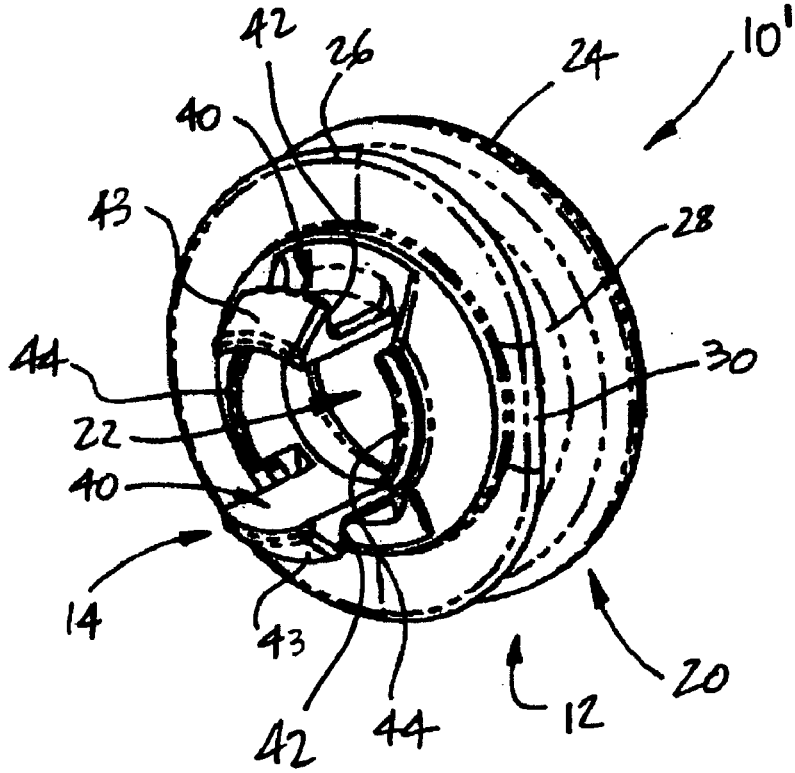
FIG. 8 is a rear perspective view of the anchoring device of FIG. 7.
Figure 9:
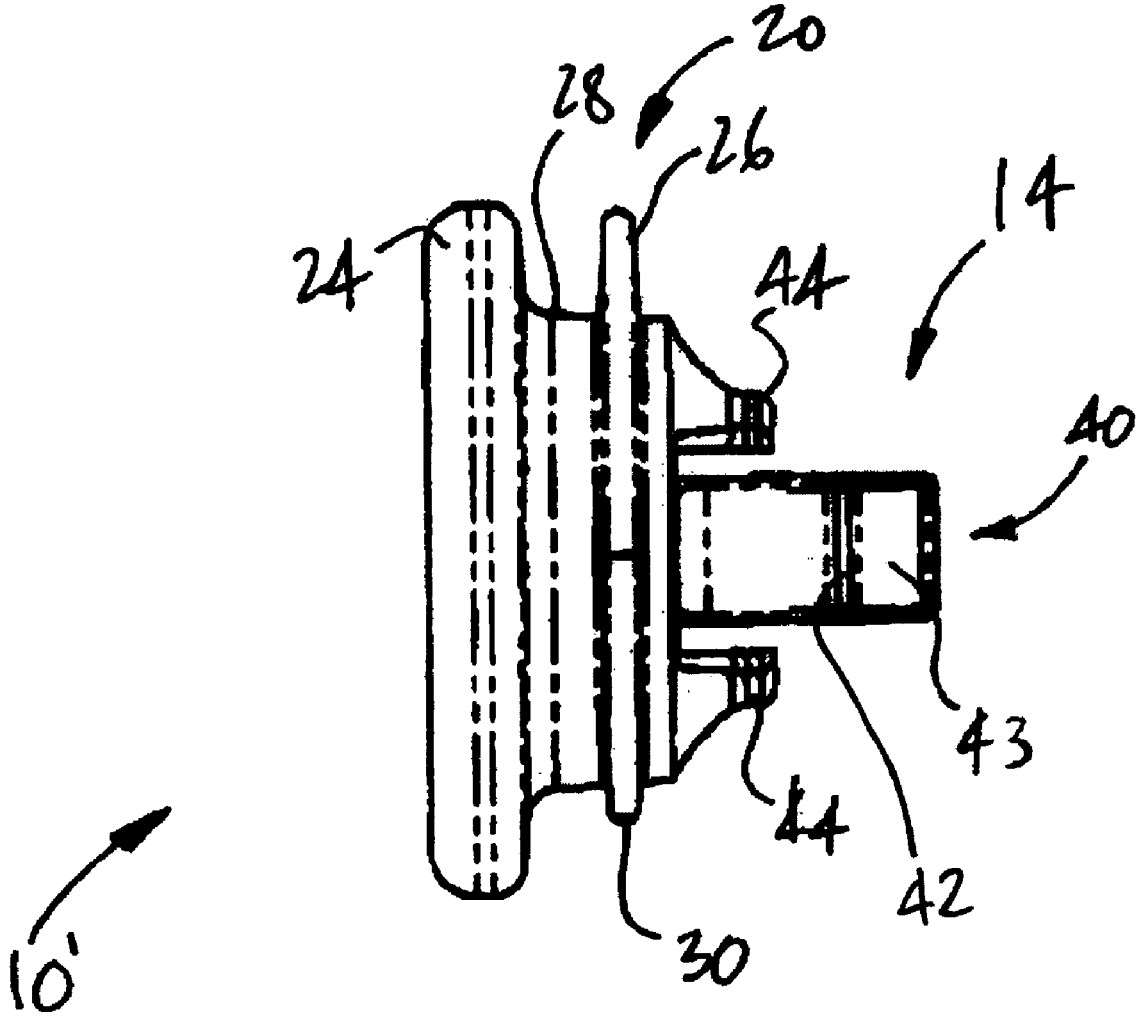
FIG. 9 is an elevation view of the anchoring device of FIG. 8.

In FIGS. 7 to 9, an alternative embodiment of the anchoring device is shown at 10'. The anchoring device 10' is essentially similar to the anchoring device 10, save for a flat peripheral groove 30, and fewer and longer fingers 40. Accordingly, like reference numerals between the first and the second embodiments will represent like elements.

As best seen in FIGS. 8 and 9, the upstream flange 26 does not define a substantially circular shape. More specifically, the upstream flange 26 has a generally flat peripheral edge 30.

The flat peripheral groove 30 is provided to facilitate the positioning of the throat C of the accessory A into the annular groove 28. More specifically, in order to secure the accessory A to the anchoring device 10, a portion of the annular groove 28 diametrically opposed to the flat peripheral edge 30, receives a portion of the throat C of the accessory A.

The flat peripheral edge 30 limits the amount of deformation or bending necessary for the engagement between the accessory A and the anchoring device 10. As the accessory A and the anchoring device 10 are manually fitted to one another, the flat peripheral edge 30 is an advantageous option.

It is pointed out that a flat peripheral edge could likewise be provided in the downstream flange 24, in addition to or instead of the flat peripheral edge 30 of the upstream flange 26. However, in many instances, the downstream flange 24 will be visible by a viewer of the accessory A, as opposed to the upstream flange 26, which will be hidden by the accessory A. Accordingly, it is esthetically preferred that the downstream flange 24 is free of a flat peripheral edge, so as to define a smooth circular shape.

A pair of wings 44 are also diametrically opposed and positioned between the fingers 40.

The wings 44 are provided to smoothen out the passage defined by the combination of the aligned passages 22 and 68.

It is contemplated to provide various configurations to the anchoring device of the present invention, in order for the anchoring device to be suited for the type of accessory it will connect to the tub walls, and to be suited to the jets of the massage systems.

For instance, some types of jets do not have a decorative cap and upstream edge, like the decorative cap 70 and upstream edge 72 illustrated in FIG. 6. Accordingly, it may be required that the fingers 40 of the anchoring device 10 are longer, to cooperate with protruding edges farther into the jet. Alternatively, it is contemplated to provide jet and anchoring device threading/tapping configurations, such that the anchoring device may be screwed to the jet, or that accessories may be screwed to the anchoring device 10.

The accessory connector 12 may be of various types. For instance, it is contemplated to provide a hook such that accessories may be hung to the anchoring device 10. Other types of connectors that will not block the passage of the jet and/or the anchoring device are alternate solutions.

It is within the ambit of the present invention to cover any obvious modifications of the embodiments described herein, provided such modifications fall within the scope of the appended claims.

The invention claimed is:

1. A cushion and anchoring device assembly for tubs, comprising:

an anchoring device comprising an annular body, at least one flange projecting radially from the annular body, an anchor interconnected to the annular body and adapted to be connected to a fluid injection jet, and a fluid passage formed in the annular body so as to enable fluid to be injected therethrough and into the tub when the anchor is connected to the fluid injection jet; and a cushion having a cushion body with at least one opening with a throat in the opening having a diameter smaller than a diameter of the flange such that the cushion is held captive solely by the at least one flange when the annular body is in the throat of the cushion to releasably connect the cushion fully inside a water-receiving cavity of the tub, the opening having a diameter greater than a diameter of the fluid passage so as not to obstruct a flow of fluid out of the fluid passage, and the cushion body projecting peripherally away from the throat for providing an abutment surface away from the fluid passage and from the anchoring device.

2. The assembly as defined in claim 1, wherein the annular body has two of said flange, with an upstream flange, a downstream flange, and a groove between the flanges, the groove having a diameter being smaller than that of both the upstream flange and the downstream flange, so as to accommodate the throat of the opening of the cushion between the flanges.

3. The assembly as defined in claim 1, wherein the anchor projects away from an upstream surface of the annular body.

4. The assembly as defined in claim 1, wherein the anchor has at least two fingers adapted to connect to the fluid injection jet.

5. The assembly as defined in claim 4, wherein each finger has a wedge at a free end of the finger to retain the anchoring device to the fluid injection jet.

6. The assembly as defined in claim 5, wherein the wedges are slanted so as to help the fingers to bend toward one another as the anchoring device is installed.

7. The assembly as defined in claim 6, wherein the anchor comprises four fingers.

* * * * *